US006712499B2

(12) United States Patent
Fink, Jr.

(10) Patent No.: US 6,712,499 B2
(45) Date of Patent: Mar. 30, 2004

(54) COMPRESSION PADDLE MIXER

(76) Inventor: James Clifford Fink, Jr., 1629 NE. 3rd St., Ocala, FL (US) 34470

( * ) Notice: Subject to any disclaimer, the term of this patent is extended or adjusted under 35 U.S.C. 154(b) by 164 days.

(21) Appl. No.: 09/972,603

(22) Filed: Oct. 4, 2001

(65) Prior Publication Data

US 2003/0067836 A1 Apr. 10, 2003

(51) Int. Cl.[7] ..... B01F 7/18
(52) U.S. Cl. ..... 366/325.5; 366/343
(58) Field of Search ..... 366/65, 325.8, 366/325.4, 325.5, 343, 279, 325.1

(56) References Cited

U.S. PATENT DOCUMENTS

| | | | | | |
|---|---|---|---|---|---|
| 29,893 | A | * | 9/1860 | Lombard | 366/325.4 |
| 85,117 | A | * | 12/1868 | Meriam | 366/343 |
| 87,691 | A | * | 3/1869 | Marsh | 366/325.4 |
| 95,075 | A | * | 9/1869 | Bradley | 366/325.8 |
| 103,803 | A | * | 5/1870 | Weston et al. | 366/325.8 |
| 230,295 | A | * | 7/1880 | Linn | 366/343 |
| 313,760 | A | * | 3/1885 | Packer | 366/343 |
| 1,208,246 | A | * | 12/1916 | Wedge | 366/325.4 |
| 1,856,732 | A | * | 5/1932 | Beran | 122/410 |
| 1,958,301 | A | * | 5/1934 | Greene | 366/325.4 |
| 2,082,752 | A | * | 6/1937 | Lewis et al. | 62/343 |
| 2,122,187 | A | * | 6/1938 | Vollrath | 366/294 |
| 2,179,271 | A | | 11/1939 | Pick | |
| 3,166,302 | A | | 1/1965 | Dixon et al. | |
| 3,551,114 | A | * | 12/1970 | Hellewell | 366/325.4 |
| 4,091,457 | A | * | 5/1978 | Slywka | 366/325.4 |
| 4,175,875 | A | | 11/1979 | Van Horbek | |
| 4,844,355 | A | | 7/1989 | Kemp, Jr. et al. | |
| 5,030,011 | A | | 7/1991 | Kronberg | |
| 5,037,209 | A | * | 8/1991 | Wyss | 366/343 |
| 5,470,148 | A | | 11/1995 | Gorr et al. | |
| 5,772,318 | A | | 6/1998 | Vadnais | |

FOREIGN PATENT DOCUMENTS

| | | |
|---|---|---|
| DE | 3907536 | 3/1999 |

* cited by examiner

*Primary Examiner*—Tony G. Soohoo
(74) *Attorney, Agent, or Firm*—Edward M. Livingston, Esq.

(57) ABSTRACT

A compression-paddle mixer has a compression paddle (1) that includes paddle blades (3) juxtaposed colinearly to a paddle rod (5). The paddle blades include one or more sets (2) of two paddle blades having channel-funneled orientation on paddle spokes (4) that are extended radially from the paddle rod. The channel-funneled orientation includes channel-funnel inlets (9) having inlet areas between leading-edges of sets of the paddle blades that are larger than inlet areas of channel-funnel outlets (11) between trailing-edges of the sets of the paddle blades in a direction of rotation of the paddle blades transmitted by rotation of the paddle rod. The compression paddle can be sized, shaped and structured for use with select sizes, shapes and structures of mix containers for select mixing applications.

32 Claims, 4 Drawing Sheets

COMPRESSION PADDLE MIXER

BACKGROUND OF THE INVENTION

This invention relates to paddle mixers of particulate substances with liquids and in particular to paddles having mixing blades oriented to compress the particulate substances and liquids together for dissolving and diffusing lumps, unmixed accumulations and bubbles.

Paddle mixers are well known historically. A wide variety have been devised for mixing various types and forms of particulate substances with various types and forms of liquids. None are known, however, to have compression paddles that are oriented for application of compressively mixing force on the particulate substances and the liquids to dissolve and to diffuse lumps and inadequately mixed accumulations or bubbles in a manner taught by this invention.

It is quite common knowledge that lumps and globs of inadequately mixed particulate substances in mixtures with liquids can be squeezed compressively to cause them to dissolve, diffuse and disintegrate into a mix. Regardless, however, paddle mixers and barrel mixers alike continue to rely on primarily agitative action that does not squeeze or compress the particulate substances and liquids. Consequently still required for conventional mixing are (1) premix of particulate substances that are likely to lump and (2) gradual addition of liquid to particulate substances during mixing action. This invention eliminates both of these conventional mixing steps for mixing most particulate substances and liquids.

Examples of most-closely related known but different devices are described in the following patent documents:

| Patent No. (U.S. unless stated otherwise) | Inventor | Issue Date |
|---|---|---|
| 4,175,875 | Van Horbek | Nov. 27, 1979 |
| DE 3,907,536 | | Mar. 8, 1989 |
| 3,166,302 | Dixon, et al. | Jan. 19, 1965 |
| 3,249,342 | Mikkelsen | May 3, 1966 |
| 5,772,318 | Vadnais | Jun. 30, 1998 |
| 5,470,148 | Gorr, et al. | Nov. 28, 1995 |
| 5,030,011 | Kronberg | Jul. 9, 1991 |
| 2,179,271 | Pick | Nov. 7, 1939 |
| 4,844,355 | Kemp, Jr., et al. | Jul. 4, 1989 |

SUMMARY OF THE INVENTION

Objects of patentable novelty and utility taught by this invention are to provide a compression-paddle mixer which:

- dissolves and diffuses lumps of inadequately mixed accumulations of particulate substances and liquids being mixed;
- squeezes out gaseous bubbles in particulate substances and liquids being mixed;
- allows adding particulate substances and liquids together in a mixing container before being mixed;
- avoids or decreases requirement of premixing pluralities of particulate substances prior to adding liquids without lumping;
- avoids requirement for successive adding of liquids to particulate substances of mixtures;
- allows insertion of a mixing paddle into and removal from particulate substances and mixtures containing large particles;

- allows insertion of a mixing paddle into and removal from particulate substances and mixtures that contain sand and gravel;
- provides for rotation of the mixing paddle with a wide selection of rotational equipment;
- is adaptable to mixture of a wide selection of particulate substances and liquids;
- is adaptable to mixture with a wide selection of sizes and structural consistencies of mixer paddles and mixing containers; and
- is well suited to mixing mortar sand, cement and water all at the same time for construction work.

This invention accomplishes these and other objectives with a compression-paddle mixer having a compression paddle that includes paddle blades juxtaposed colinearly to a paddle rod. The paddle blades include one or more sets of two paddle blades having channel-funneled orientation on paddle spokes that are extended radially from the paddle rod. The channel-funneled orientation includes a leading-edge separation of the paddle blades that is larger than a trailing-edge separation of the paddle blades in a direction of rotation of the paddle blades transmitted by rotation of the paddle rod in a mix container. The compression paddle can be sized, shaped and structured for use with select sizes, shapes and structures of mix containers for select mixing applications.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
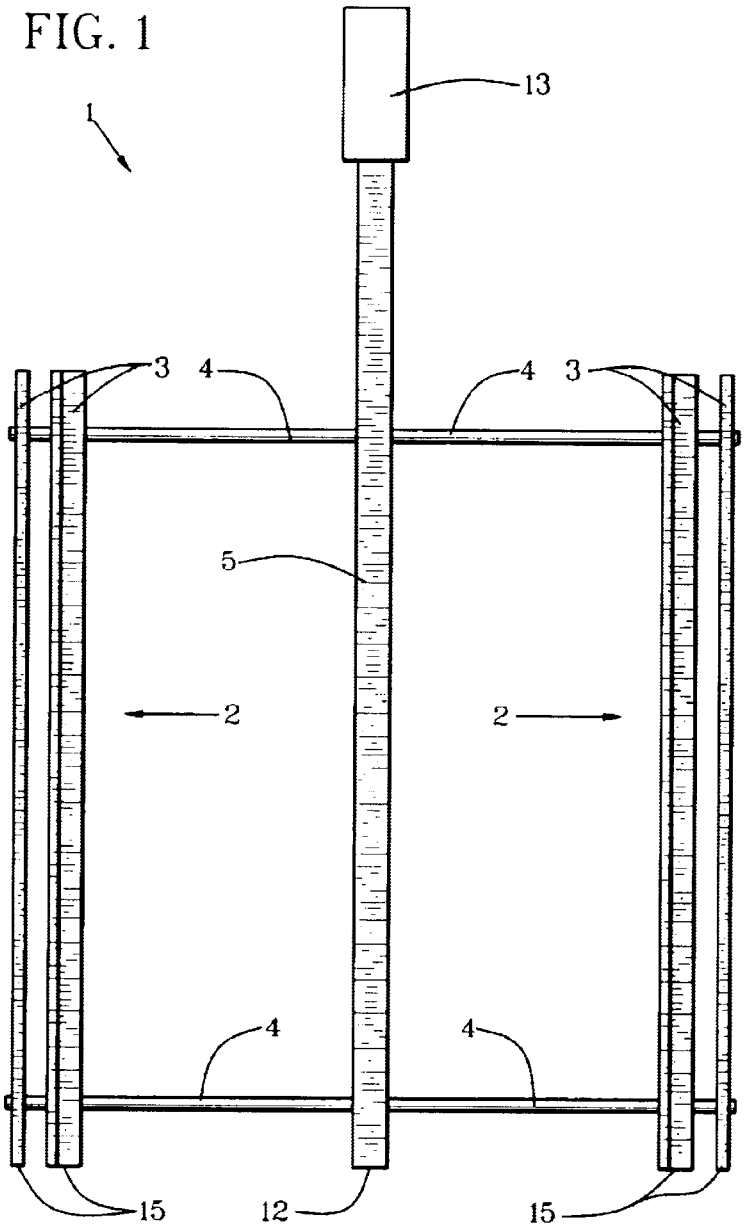
FIG. 1 is a side view of a compression paddle.
Figure 3:
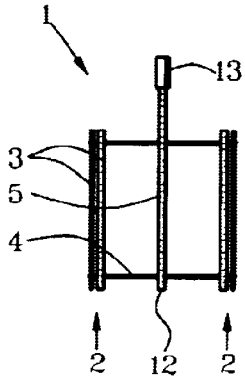
FIG. 3 is a side view of a small compression paddle for illustrating size difference ranging from barrel-plurality size for the FIG. 1 illustration to pint-plurality size for the FIG. 2 illustration and including intermediate sizes.
Figure 4:
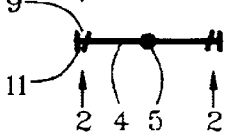
FIG. 4 is a top view of the FIG. 3 illustration.
Figure 2:
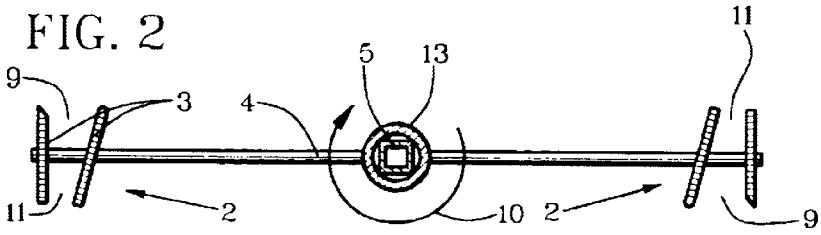
FIG. 2 is a top view of the FIG. 1 illustration.
Figure 5:
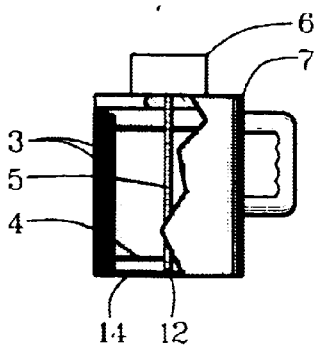
FIG. 5 is a partially cutaway side view of a pint-plurality size of compression-paddle mixer that includes a mix container having a handle to illustrate its small size.
Figure 6:
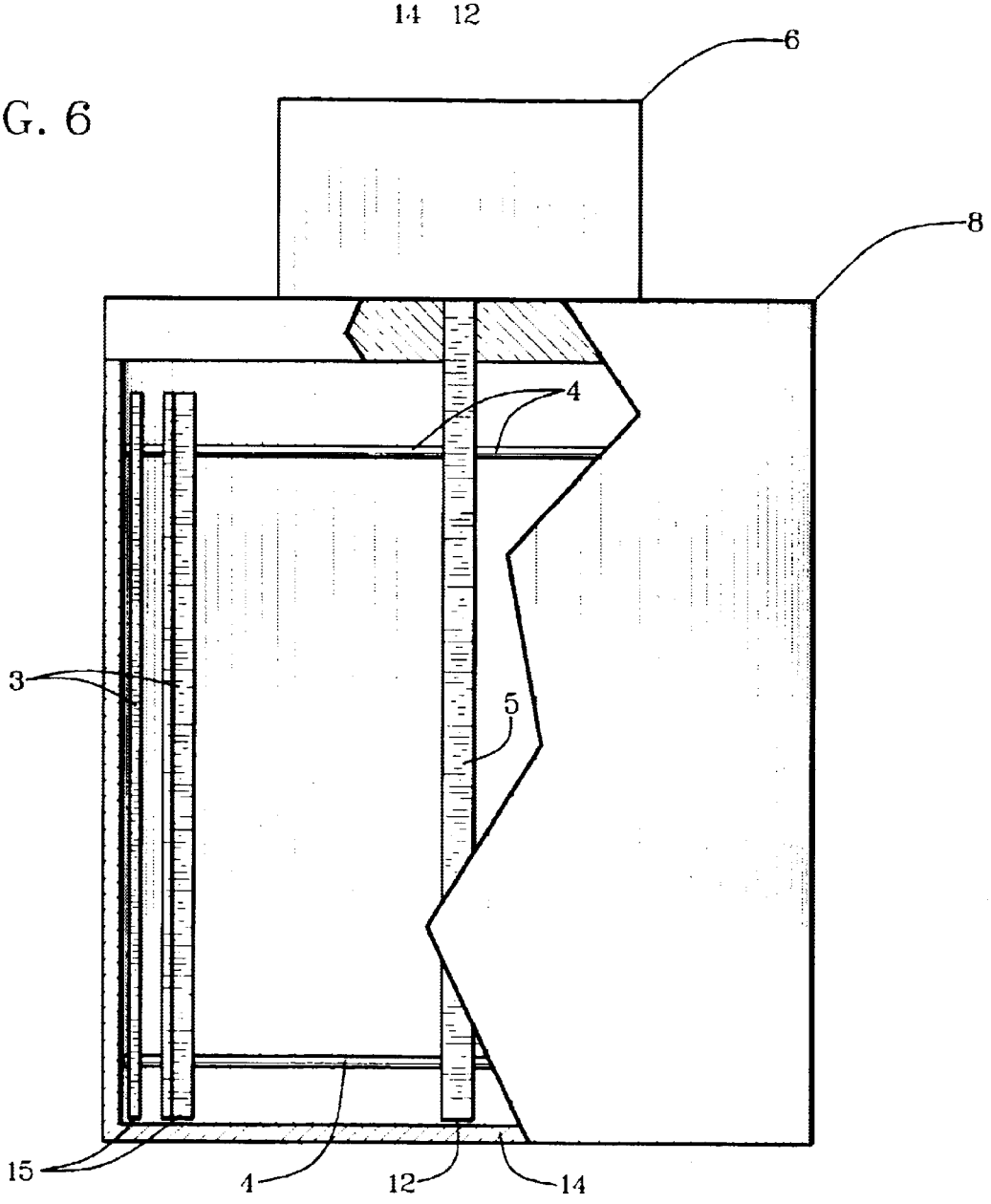
FIG. 6 is a partially cutaway side view of a large compression-paddle mixer that includes a mix container for illustrating size difference ranging from barrel-plurality size for the FIG. 6 illustration to pint-plurality size for the FIG. 5 illustration and including intermediate sizes.

Listed numerically below with reference to the drawings are terms used to describe features of this invention. These terms and numbers assigned to them designate the same features throughout this description.

| | |
|---|---|
| 1. | Compression paddle |
| 2. | Sets |
| 3. | Paddle blades |
| 4. | Paddle spokes |
| 5. | Paddle rod |
| 6. | Power source |
| 7. | Small mix container |
| 8. | Large mix container |
| 9. | Channel-funnel inlets |
| 10. | Direction-arrow arc |
| 11. | Channel-funnel outlets |
| 12. | Rod insertion end |
| 13. | Power-source connection |
| 14. | Container bottom |
| 15. | Blade bottom |
| 16. | Valved opening |
| 17. | Riser |
| 18. | Container-support surface |
| 19. | Mix accumulations |
| 20. | Mix |
| 21. | Accumulation discharge |

Referring to FIGS. 1–4, a compression-paddle mixer has a compression paddle 1 with one or more sets 2 of two paddle blades 3 on paddle spokes 4 that are extended radially from a paddle rod 5. The paddle blades 3 are juxtaposed colinearly to the paddle rod 5 and to each other.

Referring to FIGS. 1–6, the paddle-rod 5 has a direction of rotation that is transmitted from a predetermined power source 6 that can include an engine, a motor or a hand crank which can be anchored to a small mix container 7, a large mix container 8 or can be hand-held separately for mixing particulate substances, liquids or combinations of particulate substances and liquids. The one or more sets 2 of two paddle blades 3 have circumferential travel in a direction that is transmitted through the paddle spokes 4 by the rotation of the paddle rod 5.

The sets 2 of the two paddle blades 3 have channel-funneled orientations in the direction of the circumferential travel of the sets 2. The channel-funneled orientations include channel-funnel inlets 9 having funnel-inlet areas intermediate leading edges of the paddle blades 3 of the sets 2 in the direction of the circumferential travel of the sets 2 that is indicated by direction-arrow arc 10. The channel-funneled orientations include channel-funnel outlets 11 having funnel-outlet areas intermediate trailing edges of the paddle blades 3 of the sets 2. The funnel-inlet areas are predeterminedly larger than the funnel-outlet areas.

Referring to FIGS. 1–8, The channel-funneled orientations have compression ratios that are defined by ratios of the channel-funnel inlet areas to the channel-funnel outlet areas of the one or more sets 2 of the two paddle blades 3. The compression ratios are generally higher predeterminedly for mixes having high liquidity than for mixes having low liquidity relatively.

The rotation of the paddle rod 5 has a speed of rotation that is higher predeterminedly for mixes having the high liquidity than for the mixes having the low liquidity.

The compression paddle 1 has size, shape and structure articulated for predetermined quantities of mix that can range from one-to-pluralities of barrels for the large mix container 8 to one-to-pluralities of pints of the small mix container 7.

The mix containers ranging from the small mix container 7 to the large mix container 8 have a cylindrical interior periphery for a predetermined quantitative capacity of a plurality of select quantitative units ranging from pints to barrels. The compression paddle 1 has a paddle radius defined by a longest extremity of the compression paddle 1 from a center of the paddle rod 5 for articulation of the compression paddle 1 to fit and to rotate predeterminedly within the cylindrical interior of the intended small mix container 7 or the intended large mix container 8 designedly. The paddle blades 3 have lengths that proximate the length of the cylindrical interior periphery of the intended small mix container 7 or the intended large mix container 8.

The compression paddle 1, the small mix container 7 and the large mix container 8 have structure that is articulated for mixing predetermined consistencies of mix.

For articulation of the compression paddle 1, the small mix container 7 and the large mix container 8 selectively for production-item mixing, the predetermined consistencies of mix include particulate substances having construction-item consistencies of gravel, sand, cement, mortar, clay, alkalines and metallic particles selectively. Liquids for the production-item mixing include liquids having consistencies of water, liquidity modifiers, acid and petrochemicals selectively.

For articulation of the compression paddle 1, the small mix container 7 and the large mix container 8 selectively for non-production-item mixing, the predetermined consistencies of mix include non-production-item consistencies of flour, sugar, food particles, dyes and seasoning selectively. Liquids for the non-production-item consistencies of mix can include water, liquid food substances, honey, coloring, alcohol and preservatives selectively.

For most uses, the paddle blades 3 preferably, but not necessarily, have lengths which are predeterminedly longer than two radii of the compression paddle 1.

The paddle blades 3 have blade edges and blade thicknesses structured for ease of insertion into and removal from predetermined mix in the small mix container 7 and the large mix container 8 selectively. The paddle rod 5 has a rod insertion end 12 and rod thickness structured for ease of insertion into and removal from the predetermined mix. The paddle spokes 4 have thicknesses and structure articulated for ease of insertion into, rotation in and removal from the predetermined mix.

The paddle rod 4 has a rod-power end with a power-source connection 13 that is articulated for rotation-transmissive connection of the paddle rod 4 to the predetermined power source 6.

The small mix container 7 and the large mix container 8 can include a container bottom 14 that is flat and orthogonal to an axis of the paddle rod 4. Preferably the paddle blades 3 have blade bottoms 15 that travel circumferentially in predetermined proximity to the container bottom 14.

Figure 7:
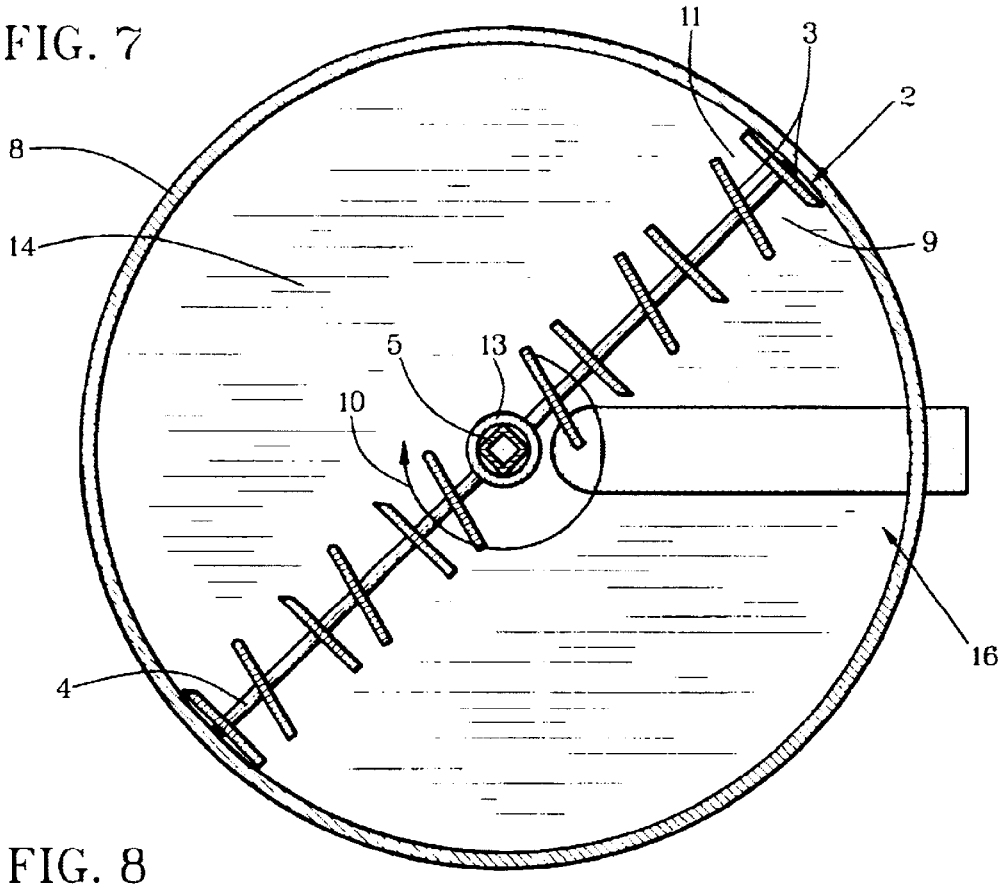
FIG. 7 is a top view of the compression-paddle mixer that includes a compression paddle having six sets of paddle blades in a mix container having a valved bottom.
Figure 8:
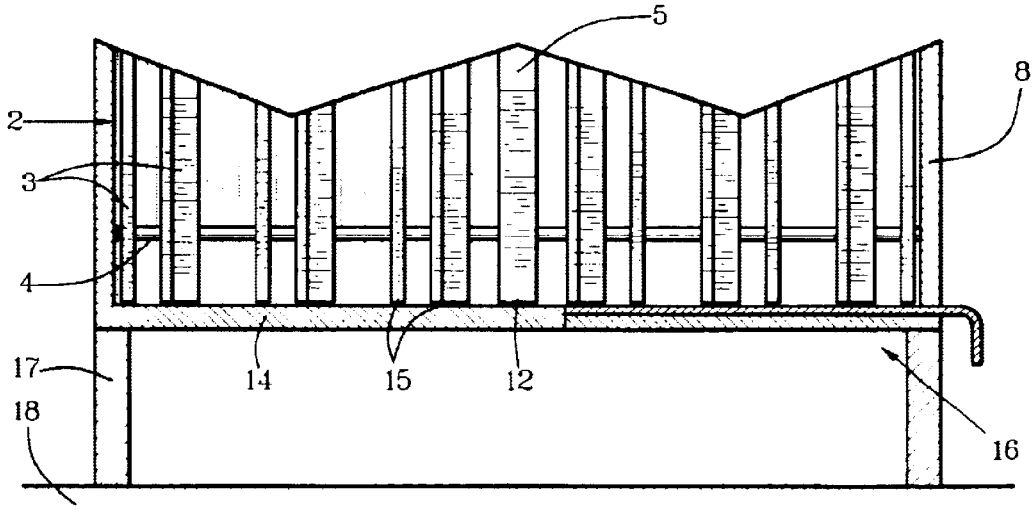
FIG. 8 is a partially cutaway side view of a bottom portion of the FIG. 7 illustration that includes a riser to position the mix container above a use platform for bottom-discharge access.

As shown for the large mix container 8 in FIGS. 7–8, the container bottom 14 can include a valved opening 16. Optionally for the valved opening 16, the container bottom 14 includes a riser 17 with which the container bottom 14 is raised predeterminedly above a container-support surface 18 for allowing exit of the mix.

Figure 9:
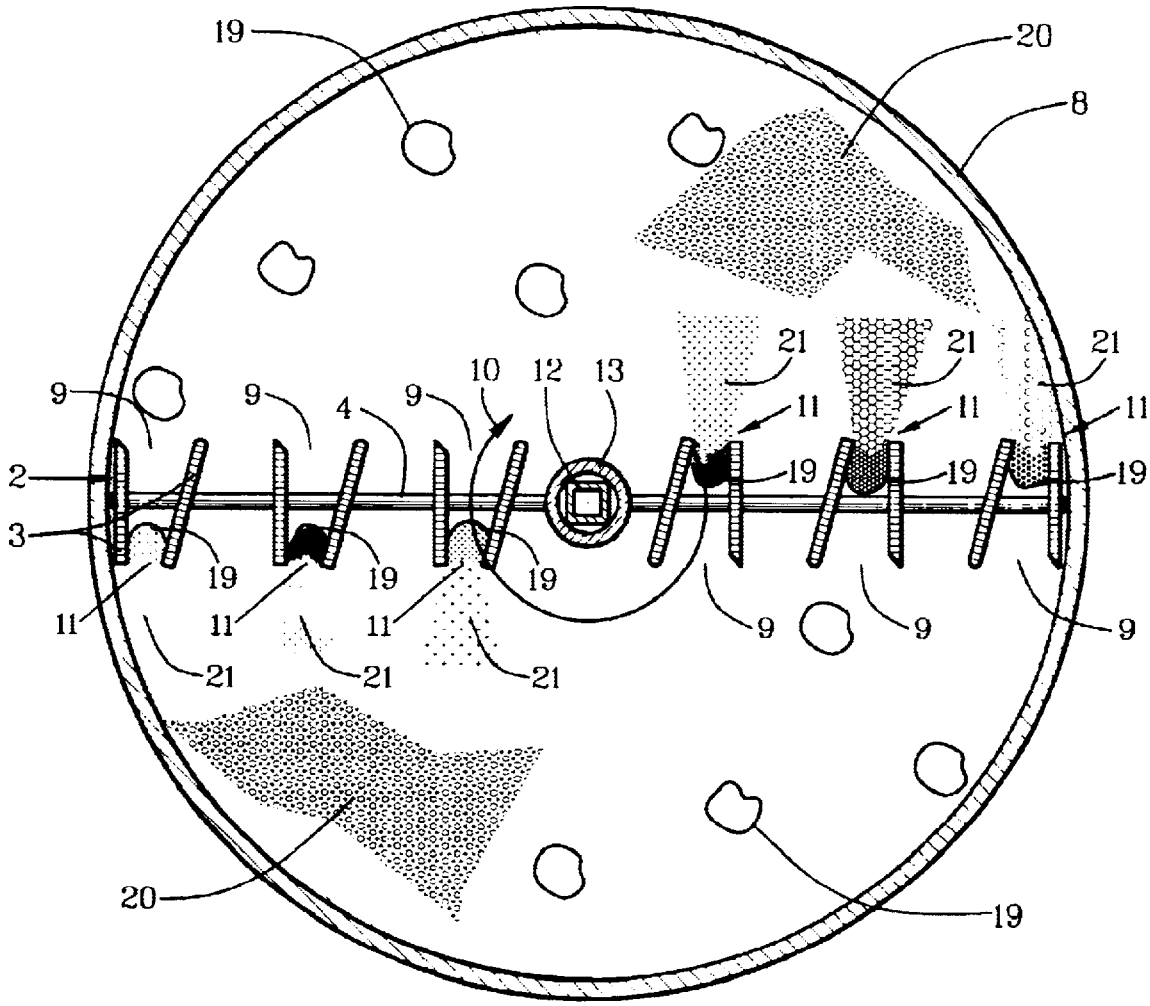
FIG. 9 is a top view of a compression-paddle mixer having a plurality of sets of paddle blades in mixing relationship to lumps, globs or accumulations of different types of substances being mixed in a mix container.

The one or more sets 2 of the paddle blades 3 can include two sets 2 as shown in FIGS. 1–6 or more as depicted by six sets 2 in FIGS. 7–9.

Referring to FIGS. 1–9, mix accumulations 19, which can include lumps, are depicted in FIG. 9 as being mixed, broken up, disintegrated, dissolved and diffused variously for different mix consistencies by the channel-funneled orientations of the sets 2 of the paddle blades 3 from rotation of the paddle rod 5 in the direction of circumferential travel indicated by the direction-arrow arc 10. The mix accumulations 19 are forced into the channel-funnel inlets 9 and funnel-compressed in directions of the channel-funnel outlets 11 by force of the circumferential travel of the sets 2 against resistance of mix 20 and against resistance of other mix accumulations 19. Released from the mix accumulations 19 at the channel-funnel outlets 11 are selections of consistencies of accumulation discharge 21 represented by illustrations of selections of fineness and shape.

This compression-paddle mixer provides not only improved agitative mixing but also eliminates conventional mixing steps of (1) pre-mix of particulate substances that are likely to lump and (2) gradual addition of liquid to particulate substances during mixing action with the compression paddle 1 in optional working relationship with the small mix container 7 and the large mix container 8 as described and claimed.

A new and useful compression-paddle mixer having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A compression-paddle mixer comprising:

a compression paddle with one or more sets of two paddle blades on paddle spokes that are extended radially from a paddle rod;

the paddle blades being juxtaposed colinearly to the paddle rod;

the paddle rod having a direction of rotation that is transmitted from a predetermined power source;

the one or more sets of the two paddle blades having circumferential travel in a direction of the circumferential travel that is transmitted through the paddle spokes by the rotation of the paddle rod;

the one or more sets of two paddle blades each having a radially outer paddle blade mounted on the paddle spokes parallel to the circumferential travel and a radially inner paddle blade which is mounted on the peddle spokes angularly to the outer paddle so that a distance between leading edges is greater than a distance between trailing edges of the paddle blades to form channel-funnel orientation in the direction of the circumferential travel;

the channel-funneled orientations include channel-funnel inlets having funnel-inlet areas intermediate leading edges of the paddle blades of the one or more sets of the paddle blades in the direction of the circumferential travel of the one or more sets of the two paddle blades;

the channel-funneled orientations include channel-funnel outlets having funnel-outlet areas intermediate trailing edges of the paddle blades of the one or more sets of the two paddle blades; and the funnel-inlet areas are predeterminedly larger than the funnel-outlet areas.

2. The compression-paddle mixer of claim 1 wherein:

the channel-funneled orientations have compression ratios that are defined by ratios of the distances between the leading edges to the trailing edges of the one or more sets of the two paddle blades.

3. The compression-paddle mixer of claim 2 wherein:

means for increasing the compression ratios predeterminedly for mixes having high liquidity than for mixes having low liquidity, said means comprising increasing the ratio of the distances between the leading edges to the trailing edges of the one or more sets of the two paddle blades.

4. The compression-paddle mixer of claim 2 wherein:

means for increasing the rotation of the paddle rod has a speed of rotation predeterminedly for the mixes having the high liquidity than for the mixes having the low liquidity, said means comprising increasing the ratio of the distances between the leading edges to the trailing edges of the one or more sets of the two paddle blades.

5. The compression-paddle mixer of claim 1 wherein:

the compression paddle has size, shape and structure articulated for predetermined quantities of mix.

6. The compression-paddle mixer of claim 5 wherein:

the predetermined quantities of mix include quantities ranging from one-to-pluralities of barrels to one-to-pluralities of pints.

7. The compression-paddle mixer of claim 1 and further comprising:

a mix container having a cylindrical interior periphery;

the cylindrical interior periphery having a predetermined quantitative capacity of a plurality of select quantitative units;

the compression paddle having a paddle radius defined by a longest extremity of the compression paddle from a center of the paddle rod;

the paddle radius being articulated to fit and to rotate predeterminedly within the cylindrical interior of the mix container; and the paddle blades having lengths that proximate a length of the cylindrical interior periphery of the mix container.

8. The compression-paddle mixer of claim 7 wherein:

the select quantitative units include quantitative units ranging from barrels to pints.

9. The compression-paddle mixer of claim 8 wherein:

the compression paddle and the mix container have structure articulated for mixing predetermined consistencies of mix.

10. The compression-paddle mixer of claim 9 wherein:

the predetermined consistencies of mix include particulate substances having construction-item consistencies of gravel, sand, cement, mortar, clay, alkalines and metallic particles selectively; and the production-item consistencies of mix include liquids having consistencies of water, liquidity modifiers, acid and petrochemicals selectively.

11. The compression-paddle mixer of claim 9 wherein:

the predetermined consistencies of mix include non-production-item consistencies of flour, sugar, food particles, dyes and seasoning selectively; and the non-production-item consistencies of mix include water, liquid food substances, honey, coloring, alcohol and preservatives selectively.

12. The compression-paddle mixer of claim 1 wherein:

the compression paddle has a paddle radius defined by a longest extremity of the compression paddle from a center of the paddle rod; and the compression paddle fits rotatably in a mix container in which radially outside extremities of the paddle blades rotate in sliding proximity to an inside periphery of a cylindrical portion of the mix container.

13. The compression-paddle mixer of claim 12 wherein:

the cylindrical portion of the mix container has a length that is predeterminedly proximate a length of the paddle blades of the compression paddle.

14. The compression-paddle mixer of claim 13 wherein:

the paddle blades of the compression paddle have lengths which are predeterminedly longer than two radii of the compression paddle.

15. The compression-paddle mixer of claim 1 wherein:

the paddle blades have blade edges and blade thicknesses structured for ease of insertion into and removal from predetermined mix in the mix container.

16. The compression-paddle mixer of claim 1 wherein:

the paddle rod has a rod-insertion end and rod thickness structured for ease of insertion into and removal from the predetermined mix in the mix container.

17. The compression-paddle mixer of claim 1 wherein:

the paddle spokes have thicknesses and structure articulated for ease of insertion into and removal from the predetermined mix in the mix container.

18. The compression-paddle mixer of claim 1 wherein:

the paddle blades have blade edges and blade thicknesses structured for ease of insertion into and removal from predetermined mix in the mix container;

the paddle rod has a rod-insertion end and rod thickness structured for ease of insertion into and removal from the predetermined mix in the mix container; and the paddle spokes have thicknesses and structure articulated for ease of insertion into and removal from the predetermined mix in the mix container.

19. The compression-paddle mixer of claim 1 wherein:

the paddle rod has a rod-power end with a power-source connection articulated for rotation-transmissive connection to the predetermined power source.

20. The compression-paddle mixer of claim 1 wherein:

the compression paddle has a paddle radius defined by a longest extremity of the compression paddle from a center of the paddle rod;

the compression paddle fits rotatably in a mix container in which radially outside extremities of the paddle blades rotate in sliding proximity to an inside periphery of a cylindrical portion of the mix container;

the cylindrical portion of the mix container has a length that is predeterminedly proximate a length of the paddle blades of the compression paddle;

the mix container includes a container bottom that is flat and orthogonal to an axis of the paddle rod; and the paddle blades have blade bottoms that travel circumferentially in predetermined proximity to the container bottom.

21. The compression-paddle mixer of claim 20 wherein:

the container bottom includes a valved opening.

22. The compression-paddle mixer of claim 21 wherein:

the container bottom is positioned on a riser to raise the container bottom predeterminedly above a container-support surface for allowing exit of the mix from the mix container predeterminedly.

23. A compression-paddle mixer comprising:

a compression paddle having two sets of two paddle blades on paddle spokes that are extended radially from a paddle rod;

the paddle blades being juxtaposed colinearly to the paddle rod;

the two sets of the two paddle blades are oppositely disposed radially from the paddle rod;

the paddle rod having a direction of rotation that is transmitted from a predetermined power source;

the two sets of the two paddle blades having circumferential travel in a direction of the circumferential travel that is transmitted through the paddle spokes by the rotation of the paddle rod;

the one or more sets of two paddle blades each having a radially outer paddle blade mounted on the paddle spokes parallel to the circumferential travel and a radially inner paddle blade which is mounted on the peddle spokes angularly to the outer paddle so that a distance between the leading edges is greater than a distance between trailing edges of the paddle blades to form channel-funnel orientation in the direction of the circumferential travel;

the channel-funneled orientations include channel-funnel inlets having funnel-inlet areas intermediate leading edges of the paddle blades of the two sets of the paddle blades in the direction of the circumferential travel thereof;

the channel-funneled orientations include channel-funnel outlets having funnel-outlet areas intermediate trailing edges of the paddle blades of the two sets of the two paddle blades;

the funnel-inlet areas are predeterminedly larger than the funnel-outlet areas;

the channel-funneled orientations have compression ratios that are defined by ratios of the channel-funnel inlet areas to the channel-funnel outlet areas of the two sets of the two paddle blades;

the compression ratios are higher predeterminedly for mixes having high liquidity than for mixes having low liquidity; and the rotation of the peddle rod has a speed of rotation that is higher predeterminedly for the mixes having the high liquidity than for the mixes having the low liquidity.

24. The compression-paddle mixer of claim 23 wherein:

the compression paddle has size, shape and structure articulated for predetermined quantities of mix;

the predetermined quantities of mix include quantities ranging from pluralities of barrels to pluralities of pints.

25. The compression-paddle mixer of claim 23 and further comprising:

a mix container having a cylindrical interior periphery;

the cylindrical interior periphery having a predetermined quantitative capacity of a plurality of select quantitative units;

the compression paddle having a paddle radius defined by a longest extremity of the compression paddle from a center of the paddle rod;

the paddle radius being articulated to fit and to rotate predeterminedly within the cylindrical interior of the mix container;

the paddle blades having lengths that proximate a length of the cylindrical interior periphery of mix container;

the select quantitative units include quantitative units ranging from barrels to pints; and the compression paddle and the mix container have structure articulated for predetermined consistencies of mix.

26. The compression-paddle mixer of claim 25 wherein:

the predetermined consistencies of mix include gravel, sand, cement, mortar, clay, alkalines, and metallic particles selectively; and the predetermined consistencies of mix include water, acid and petrochemicals selectively.

27. The compression-paddle mixer of claim 25 wherein:

the predetermined consistencies of mix include flour, sugar, food particles and seasoning selectively; and the predetermined consistencies of mix include water, liquid food substances, honey, coloring, alcohol and preservatives selectively.

28. The compression-paddle mixer of claim 23 wherein:

the compression paddle has a paddle radius defined by a longest extremity of the compression paddle from a center of the paddle rod; and the compression paddle fits rotatably in a mix container in which radially outside extremities of the paddle blades rotate in sliding proximity to an inside periphery of a cylindrical portion of the mix container;

the cylindrical portion of the mix container has a length that is predeterminedly proximate a length of the paddle blades of the compression paddle; and the paddle blades of the compression paddle have lengths which are predeterminedly longer than two radii of the compression paddle.

29. The compression-paddle mixer of claim 23 wherein:

the paddle blades have blade edges and blade thicknesses structured for ease of insertion into and removal from predetermined mix in the mix container;

the paddle rod has rod-insertion end and rod thickness structured for ease of insertion into and removal from the predetermined mix in the mix container;

the paddle spokes have thicknesses and structure articulated for ease of insertion into and removal from the predetermined mix in the mix container; and the paddle rod has a rod-power end with a power-source connection articulated for rotation-transmissive connection to the predetermined power source.

30. A compression-paddle mixer comprising:

a compression paddle having two sets of two paddle blades on paddle spokes that are extended radially from a paddle rod;

the paddle blades being juxtaposed colinearly to the paddle rod;

the two sets of the two paddle blades are oppositely disposed radially from the paddle rod;

the paddle rod having a direction of rotation that is transmitted from a predetermined power source;

the two sets of the two paddle blades having circumferential travel in a direction of the circumferential travel that is transmitted through the paddle spokes by the rotation of the paddle rod;

the one or more sets of two paddle blades each having a radially outer paddle blade mounted on the paddle spokes parallel to the circumferential travel and a radially inner paddle blade which is mounted on the peddle spokes angularly to the outer paddle so that a distance between leading edges is greater than a distance between trailing edges of the paddle blades to form channel-funnel orientation in the direction of the circumferential travel;

the channel-funneled orientations include channel-funnel inlets having funnel-inlet areas intermediate leading edges of the paddle blades of the two sets of the paddle blades in the direction of the circumferential travel thereof;

the channel-funneled orientations include channel-funnel outlets having funnel-outlet areas intermediate trailing edges of the paddle blades of the two sets of the two paddle blades;

the funnel-inlet areas are predeterminedly larger than the funnel-outlet areas; and the channel-funneled orientations have compression ratios that are defined by ratios of the channel-funnel inlet areas to the channel-funnel outlet areas of the two sets of the two paddle blades.

31. The compression-paddle mixer of claim 30 wherein:

the compression paddle has a paddle radius defined by a longest extremity of the compression paddle from a center of the paddle rod;

the compression paddle fits rotatably in a mix container in which radially outside extremities of the paddle blades rotate in sliding proximity to an inside periphery of a cylindrical portion of the mix container;

the cylindrical portion of the mix container has a length that is predeterminedly proximate a length of the paddle blades of the compression paddle;

the mix container includes a container bottom that is flat and orthogonal to an axis of the paddle rod; and the paddle blades have blade bottoms that travel circumferentially in predetermined proximity to the container bottom.

32. The compression-paddle mixer of claim 31 wherein:

the container bottom includes a valved opening; and the container bottom has a bottom exterior that is raised predeterminedly above a container-support surface for allowing exit of the mix from the mix container predeterminedly.

* * * * *